US007246059B2

(12) United States Patent
Behboodian et al.

(10) Patent No.: US 7,246,059 B2
(45) Date of Patent: Jul. 17, 2007

(54) METHOD FOR FAST DYNAMIC ESTIMATION OF BACKGROUND NOISE

(75) Inventors: Ali Behboodian, Plantation, FL (US); Pratik Desai, Boca Raton, FL (US); Chin Pan Wong, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 956 days.

(21) Appl. No.: 10/626,321

(22) Filed: Jul. 24, 2003

(65) Prior Publication Data

US 2004/0137846 A1 Jul. 15, 2004

Related U.S. Application Data

(60) Provisional application No. 60/398,577, filed on Jul. 26, 2002.

(51) Int. Cl.
*G10L 11/00* (2006.01)
*G10L 21/02* (2006.01)

(52) U.S. Cl. ..... 704/226; 704/207; 704/208; 704/228

(58) Field of Classification Search ..... 704/205, 704/206, 207, 208, 214, 215, 226, 227, 228
See application file for complete search history.

(56) References Cited

U.S. PATENT DOCUMENTS 4,015,088 A 3/1977 Dubnowski et al.
5,012,519 A * 4/1991 Adlersberg et al. ..... 704/226
5,357,567 A * 10/1994 Barron et al. ..... 379/406.06
5,410,632 A * 4/1995 Hong et al. ..... 704/233
5,485,522 A * 1/1996 Solve et al. ..... 381/56
5,504,473 A 4/1996 Cecic et al.
5,537,509 A * 7/1996 Swaminathan et al. ..... 704/228
5,677,960 A * 10/1997 Unno et al. ..... 381/86
5,708,754 A * 1/1998 Wynn ..... 704/219
5,742,694 A * 4/1998 Eatwell ..... 381/94.2
5,784,476 A 7/1998 Bird
5,949,888 A * 9/1999 Gupta et al. ..... 381/66
6,223,154 B1 * 4/2001 Nicholls et al. ..... 704/233
6,389,391 B1 * 5/2002 Terauchi ..... 704/233
6,556,967 B1 * 4/2003 Nelson et al. ..... 704/233
6,766,020 B1 * 7/2004 Tian et al. ..... 379/406.05
7,171,357 B2 * 1/2007 Boland ..... 704/231

* cited by examiner

*Primary Examiner*—Martin Lerner

(57) ABSTRACT

The invention provides a method and system for dynamically estimating background noise. The system includes a portable communication device, a vocoder, and a voice activated detector. Based on information received by the portable communication device, the vocoder determines parameters related to incoming information including a voicing mode indicative of the periodicity of incoming information. The voice activated detector then compares the voicing mode to a threshold to determine whether a background noise estimate should be updated. The method includes the steps of: receiving a periodicity indicator and a current comfort noise level for an incoming voice frame; comparing the periodicity indicator with a predetermined threshold if the current comfort noise level is equal to a previous comfort noise level; and maintaining a background noise estimate if the periodicity indicator exceeds the predetermined threshold and revising a background noise estimate if the periodicity indicator does not exceed the predetermined threshold.

12 Claims, 3 Drawing Sheets

METHOD FOR FAST DYNAMIC ESTIMATION OF BACKGROUND NOISE

CROSS-REFERENCE TO RELATED APPLICATIONS

This application is related to U.S. Provisional Application Serial No. 60/398,577 filed Jul. 26, 2002 entitled "METHOD FOR FAST DYNAMIC ESTIMATION OF BACKGROUND NOISE", from which this application claims priority, and which application is incorporated herein by reference.

TECHNICAL FIELD

This invention is generally related to mobile units and more particularly to portable communication devices operable in speakerphone mode.

BACKGROUND OF THE INVENTION

Speakerphones are used in many settings by both individuals and businesses to facilitate communication between multiple parties and to provide a hands-free setting. Speakerphones are frequently used in automobiles so that a user will not have to handle a receiver while operating the automobile. Many speakerphones are half duplex speakerphones, in which only one party can occupy a communication channel at a time. Once one party gets the channel, the other party must wait until the channel is free to proceed.

If a speakerphone is used in an environment in which the noise level increases suddenly, outbound audio may become temporarily muted. For example, automobile acceleration increases the overall noise level such as in a car, such that when an automobile starts moving, the outbound audio will become muted for a period of time that may encompass 8 to 10 seconds.

The muting is caused by an inbound voice activated detector (VAD) detecting the sudden increase in noise as near-end speech. Since the VAD detects speech rather than noise, it locks the inbound channel. It takes about 8 to 10 seconds for the VAD to revert back to its normal operation. The VAD is unable to adapt quickly enough to recognize the increase in the background noise level. This causes the noise level to break in and lock the channel. Accordingly, a technique is needed for more quickly detecting the increased noise level and releasing the channel for possible outbound use to avoid blocking outbound speech.

SUMMARY OF THE INVENTION

Accordingly, in order to overcome the aforementioned deficiencies, an aspect of the invention provides a method for dynamically estimating background noise. The method comprises generating a periodicity indicator and a current comfort noise level for an incoming voice frame; comparing the periodicity indicator with a predetermined threshold if the current comfort noise level is equal to a previous comfort noise level; and maintaining a background noise estimate if the periodicity indicator exceeds the predetermined threshold and revising the background noise estimate if the periodicity indicator does not exceed the predetermined threshold.

In yet another aspect, the invention comprises a method for detecting an increase in noise level in a half-duplex speakerphone environment so as to avoid blocking outgoing speech. The method comprises determining a current comfort noise level; comparing the current comfort noise level to a previous comfort noise level; determining if a current periodicity indicator is greater than a predetermined threshold if the current comfort noise level equals the previous comfort noise level; and maintaining a background noise estimate if the periodicity indicator exceeds the predetermined threshold and revising the background noise estimate and keeping an outbound channel open if the current periodicity indicator does not exceed the predetermined threshold.

In yet another aspect, the invention comprises a system for dynamically estimating background noise. The system comprises a portable communication device for receiving incoming information and a vocoder for determining parameters related to the incoming information. The parameters include a voicing mode that indicates periodicity of the incoming information. The system additionally comprises a voice activated detector for processing the parameters for determining a background noise estimate. The voice activated detector comprises a mechanism for comparing the current voicing mode to a predetermined threshold, wherein an outbound channel remains open unless the voicing mode exceeds the predetermined threshold.

DETAILED DESCRIPTION

Figure 1:
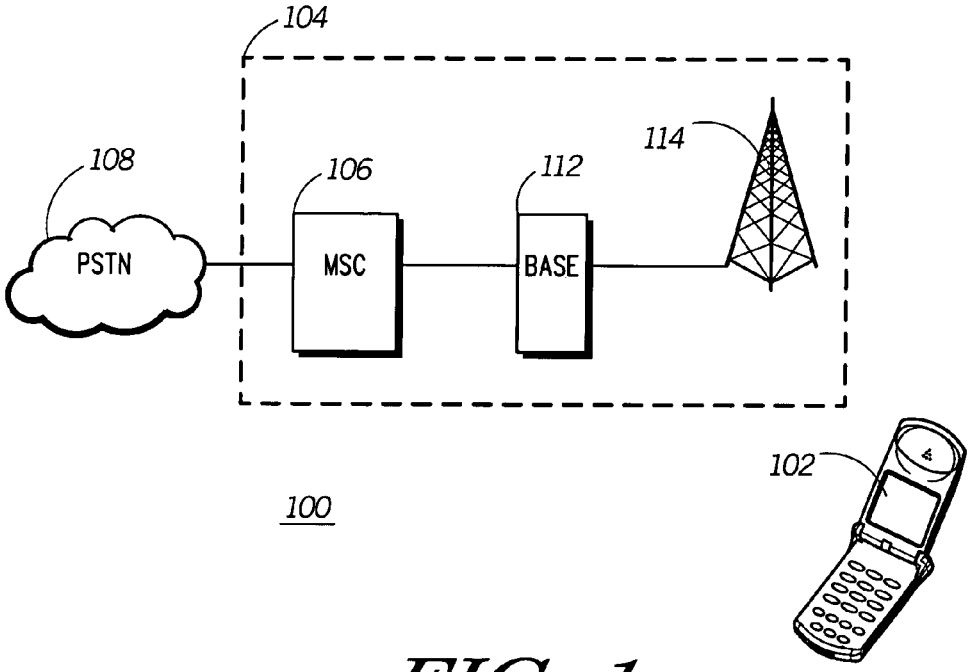
FIG. 1 shows a cellular communication system diagram.

While the specification concludes with claims defining the features of the invention that are regarded as novel, it is believed that the invention will be better understood from a consideration of the following description in conjunction with the drawing figures, in which like reference numerals are carried forward. Generally in audio equipment, speech and other audio data are broken into frames. Various parameters are contained within each frame, such as an energy parameter and a voicing mode parameter. The voicing mode parameter is a value indicative of tonal content or periodicity of a frame. In general, a low voicing mode value indicates a fricative sound, wherein a high value indicates a tonal sound, such as a vowel.

These aforementioned parameters may be generated by transmitting equipment so that a portable communication device receiving the information has the parameters available. Alternatively, the receiving device may compute the above-identified parameters. The receiving portable communication device further uses the values of these parameters to define average values and threshold values.

With reference to FIG. 1, a cellular communication system 100 includes a portable communication device 102. The communication system 100 may further include fixed network equipment (FNE) 104, which may include a mobile switching center (MSC) 106 operably coupled to a publicly switched telephone network (PSTN) 108 and a transcoder 110. The transcoder 110 converts audio data into vocoded information by any known vocoding algorithms. The transcoder 110 may encode an outbound audio signal and provide it to a base station 112 in the vicinity of the portable communication device 102. The base station 112 may include transceiver equipment and an antenna 114 over which the vocoded signal is transmitted to the portable communication device 102.

Figure 2:
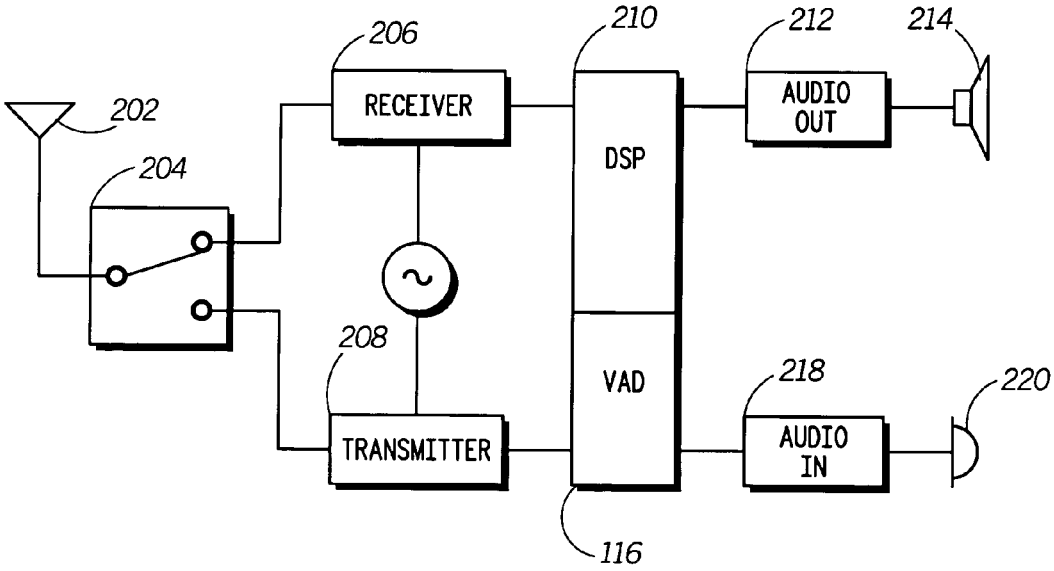
FIG. 2 is a block diagram of a portable communication device.

FIG. 2 is a diagram showing the portable communication device 102, which is operable in speakerphone mode in accordance with an embodiment of the invention. The portable communication device 102 comprises an antenna 202 coupled to an antenna switch 204. The antenna switch 204 selectively couples the antenna 202 to a receiver 206 and a transmitter 208. Both the receiver 206 and the transmitter 208 are coupled to a digital signal processor (DSP) 210. The DSP 210 provides a mechanism for calculating and providing values and may perform functions such as vocoding. The DSP 210 may pass received audio information to an audio-out circuit 212 for playing over a speaker 214. The portable communication device 102 additionally comprises an audio-in circuit 218 for processing audio information received from a microphone 220. The audio-in 218 and audio-out 212 circuits may be separate or may be combined in a single codec. The audio-in circuit 218 passes signals to the DSP 210, which performs functions such as encoding and baseband processing. The transmitter 208 modulates the baseband signal provided by the DSP 210 and transmits the inbound signal to the base station 112.

The portable communication device 102 additionally includes a voice activated detector 116. The DSP or vocoder 210 outputs multiple parameters related to incoming information. One of these parameters is "r0", which indicates amount of energy in a segment of speech. A high r0 indicates loud speech and a low r0 indicates soft speech. Another of these parameters is Vm, or voicing mode. The voicing mode indicates how periodic a segment of incoming information is. Periodic speech has a high voicing mode. Vowels have a high voicing mode. Noise other than speech that has no pattern has a low voicing mode. Therefore, in general, a high voicing mode indicates the presence of speech.

Another parameter output by the vocoder 210 is the comfort noise level "CNR0". Since transmitting silence is wasteful, the vocoder 210 estimates comfort noise and transmits CNR0 when it doesn't detect speech.

As set forth above, a problem with prior art is that while background noise increases, the portable communication device 102 fails to register an immediate increase in CNR0. However, the r0 increase is not delayed, so 8-10 seconds of speech is declared when there is no speech. Accordingly, the present system and method aim to better estimate CNR0. "Ib_r0_avg" is the name given to the CNR0 curve.

Since the increase in CNR0 is not immediately recognized, the processing tools of the present invention including the VAD 116 compare the CNR0 for each consecutive segment of incoming information. If the CNR0 has not changed or is equal between two segments, the processing tools further investigate to determine whether any CNR0 increase should be present. The investigation process is further described below with reference to the method of the invention.

Figure 3:
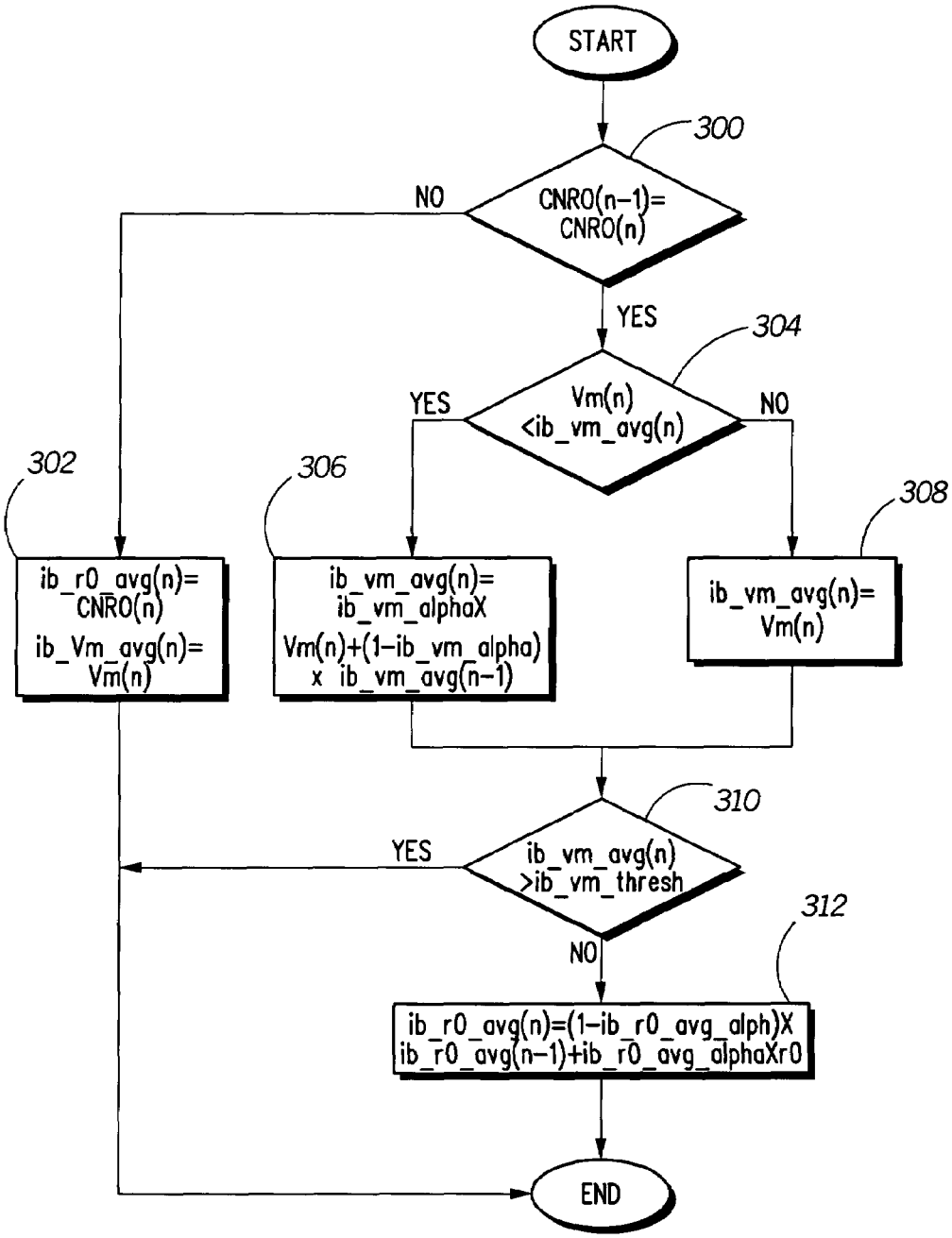
FIG. 3 is a flowchart illustrating a method for dynamically estimating background noise.

The method for dynamically estimating background noise in order to avoiding locking an outbound channel is shown in detail in FIG. 3. In step 300, after the portable communication device 102 receives an incoming voice frame, it compares the CNR0 of the incoming voice frame with the CNR0 of the immediately previous voice frame.

If the CNR0 of the two voice frames is not equal, in step 302 the VAD 116 sets ib_r0_avg equal to the current CNR0:

$$ib_r0_\mathrm{avg}(n)=CNR0(n) \tag{1}$$

and sets ib_vm_avg to the current value of the voicing mode.

$$ib_vm_\mathrm{avg}(n)=Vm(n) \tag{2}$$

If however in step 300, the CNR0 of the two voice frames is equal, further investigation is required because the equality may be due to a delayed response.

Accordingly, in step 304, the VAD 116 determines whether the current Vm is less than ib_vm_avg. If the VAD 116 determines that the current Vm is less than ib_vm_avg, the VAD 116 modifies ib_vm_avg with a smoothing factor "alpha" in step 306. More specifically, the VAD 116 employs the formula:

$$ib_vm_\mathrm{avg}(n)=ib_vm_\mathrm{alpha}\times Vm(n)+(1-ib_vm_\mathrm{alpha})\times ib_vm_\mathrm{avg}(n-1) \tag{3}$$

If in step 304, the VAD 116 determines that Vm is not less than ib_vm_avg, the VAD sets ib_vm_avg equal to the current Vm in step 308:

$$ib_vm_avg(n)=Vm(n) \tag{4}$$

Following steps 306 and 308, the VAD 116 determines in step 310 if the ib_vm_avg is greater than ib_vm_thresh. If the smoothed voicing mode ib_vm_avg is greater than the threshold ib_vm_thresh, no adjustment is needed. However if ib_vm_avg is not greater than iv_vm_thresh, the background noise estimate must be updated. If the smoothed voicing mode is lower than a threshold, then the voice frame energy is low passed and used to estimate the background noise level. This is based on the assumption that noise has a low voicing mode. In the case of a sudden increase in noise level, the voicing mode stays low and hence the threshold is updated. Updating of the threshold prevents the noise energy from being detected as speech. Accordingly, in step 312, the VAD 116 updates ib_r0_avg:

$$ib_ro_\mathrm{avg}(n)=(1-ib_r0_\mathrm{avg_alpha})\times ib_r0_\mathrm{avg_alpha}\times r0 \tag{5}$$

To correctly detect the in-bound speech, a smoothed version of the in-bound energy is compared against a dynamically adjusted threshold. This threshold is a function of the in-bound background noise. The louder the background noise, the higher the threshold should be to avoid false detection. Therefore, the present technique adjusts the threshold dynamically such that the in-bound VAD does not falsely detect even under extreme noise situations. The adaptation is based on the voicing mode of the voice frame as well as the energy of that frame.

Figure 4:
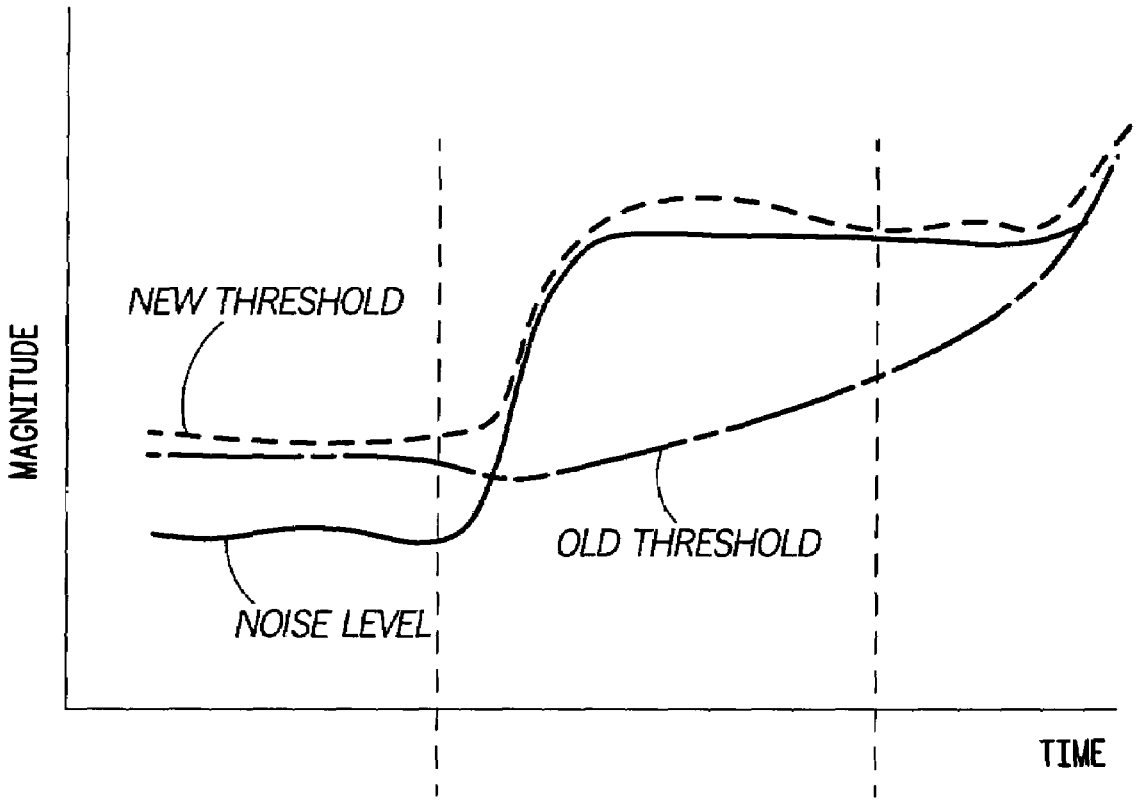
FIG. 4 is a graph illustrating noise levels and thresholds.

As shown in FIG. 4 above, as long as the noise level, represented by the solid line, is below the threshold, noise is not detected as speech and the channel will therefore not be locked. When the noise level suddenly increases, the threshold closely follows the noise level to prevent a break in. The old threshold is represented by the large dashed line. The new threshold is represented by the smaller dashed line. As shown, the smaller dashed line reflecting the new adjusted threshold adjusts more quickly to the noise level represented by the solid line.

The use of the voicing mode to estimate background noise prevents false detection of speech in many instances. Prior to the implementation of the above-identified technique, a device may have experienced an 8-10 second delay in the increase in CNR0. With the implementation of the above-identified technique, the delay in the same devices may be reduced to about ½ second.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

We claim:

1. A method for dynamically estimating background noise comprising:

generating a periodicity indicator and a current comfort noise level for an incoming voice frame;

comparing the periodicity indicator with a predetermined threshold if the current comfort noise level is equal to a previous comfort noise level;

maintaining a background noise estimate if the periodicity indicator exceeds the predetermined threshold and revising the background noise estimate if the periodicity indicator does not exceed the predetermined threshold.

2. The method of claim 1, further comprising:

setting the background noise estimate and an average periodicity estimate if the current comfort noise level is not equal to the previous comfort noise level.

3. The method of claim 1, further comprising calculating a smoothed version of the periodicity indicator prior to comparing the periodicity indicator with the predetermined threshold.

4. The method of claim 1, further comprising keeping an outbound channel open if the periodicity indicator does not exceed the predetermined threshold.

5. A method for detecting an increase in noise level in a half-duplex speakerphone environment so as to avoid blocking outgoing speech, the method comprising:

determining a current comfort noise level;

comparing the current comfort noise level to a previous comfort noise level;

determining if a current periodicity indicator is greater than a predetermined threshold if the current comfort noise level equals the previous comfort noise level; and maintaining a background noise estimate if the periodicity indicator exceeds the predetermined threshold and revising the background noise estimate and keeping an outbound channel open if the current periodicity indicator does not exceed the predetermined threshold.

6. The method of claim 5, further comprising:

setting the background noise estimate and an average periodicity estimate if the current comfort noise level is not equal to the previous comfort noise level.

7. The method of claim 5, further comprising calculating a smoothed version of the periodicity indicator prior to comparing the periodicity indicator with the predetermined threshold.

8. The method of claim 5, further comprising updating the background noise estimate if the periodicity indicator does not exceed the predetermined threshold.

9. A system for dynamically estimating background noise, the system comprising:

a portable communication device for receiving incoming information;

a vocoder for determining parameters related to the incoming information, the parameters including a voicing mode that indicates periodicity of the incoming information;

a voice activated detector for processing the parameters for determining a background noise estimate, the voice activated detector comprising a mechanism for comparing the current voicing mode to a predetermined threshold, wherein an outbound channel remains open unless the voicing mode exceeds the predetermined threshold.

10. The system of claim 9, further comprising:

setting the background noise estimate and an average periodicity estimate if the current comfort noise level is not equal to the previous comfort noise level.

11. The system of claim 9, further comprising calculating a smoothed version of the periodicity indicator prior to comparing the periodicity indicator with the predetermined threshold.

12. The system of claim 9, further comprising updating the background noise estimate if the periodicity indicator does not exceed the predetermined threshold.

* * * * *